United States Patent [19]

Robinet

[11] 4,041,614

[45] Aug. 16, 1977

[54] CLOTHES DRYER

[76] Inventor: Norman A. Robinet, 404-6505 Huntridge Hill NE., Calgary, Alberta, Canada, T2K5E5

[21] Appl. No.: 704,321

[22] Filed: July 12, 1976

[51] Int. Cl.[2] ..... F26B 21/10

[52] U.S. Cl. ..... 34/92; 34/128; 34/140

[58] Field of Search ..... 34/92, 15, 16, 51, 242, 34/128, 140, 39, 40; 418/263

[56] References Cited

U.S. PATENT DOCUMENTS

| | | | |
|---|---|---|---|
| 661,568 | 11/1900 | Walter | 34/140 |
| 1,628,481 | 5/1927 | Vernay | 34/92 |
| 1,698,235 | 1/1929 | Mathis | 418/263 X |
| 1,996,347 | 4/1935 | Reppery | 34/128 |
| 2,388,917 | 11/1945 | Hormel | 34/92 X |
| 2,406,494 | 8/1946 | Ferris | 34/133 |
| 2,495,535 | 1/1950 | Morrison | 34/92 X |
| 2,555,821 | 6/1951 | Smith | 34/92 |
| 2,588,966 | 3/1952 | Dale | 34/60 |
| 2,921,384 | 1/1950 | Smith | 34/133 |
| 3,416,334 | 12/1968 | Candor et al. | 34/92 |
| 3,425,136 | 2/1969 | Lambert | 34/92 |
| 3,546,783 | 12/1970 | Candor et al. | 34/92 |

FOREIGN PATENT DOCUMENTS

| | | | |
|---|---|---|---|
| 131,456 | 8/1919 | United Kingdom | 34/140 |

*Primary Examiner*—William F. O'Dea
*Assistant Examiner*—Harold Joyce
*Attorney, Agent, or Firm*—Finnegan, Henderson, Farabow & Garrett

[57] ABSTRACT

The embodiment of the clothes dryer disclosed herein shows apparatus which operates on a vacuum principle to dry clothes or other material rapidly and economically. A rotary vane vacuum pump is incorporated into the dryer to efficiently exhaust the clothes holding compartment during rotation of a double drum assembly. The pump which is affixed to the stationary center shaft has a rotor which rotates with the double drum assembly. A radiant heating element can be mounted on the stationary horizontal center shaft directed into the clothes holding compartment to expedite the drying process.

5 Claims, 6 Drawing Figures

CLOTHES DRYER

BACKGROUND OF THE INVENTION

The present invention relates to an apparatus for drying fabrics and in particular clothes.

There are in the prior art clothes dryers which operate by tumbling the clothes in an enclosed drum while raising the temperature sufficiently to cause evaporation of moisture from the clothes. There also have been attempts to evacuate a closed compartment in which the wet clothes are placed thereby expediting the removal of moisture from the wet clothes and other cloth materials. By reducing the pressure within the compartment the moisture can be removed from the clothes at a lower temperature.

There have been other attempts to enhance the performance of a clothes dryer by placing a radiant heat element adjacent the clothes compartment to raise the temperature of the clothes drying compartment and thereby additionally quicken the drying process.

SUMMARY OF THE INVENTION

The present invention represents a significant improvement over prior art devices by providing a rotatable double drum assembly journaled on a stationary horizontal shaft and communicating with an exhaust mechanism, such as a pump, for removing air and water vapor from the interior of the closed compartment. A radiant heat element mounted on the shaft and directed into the compartment for holding clothes enhances the removal of moisture from the wet clothes or other materials contained in the compartment.

In accordance with the purpose of the invention, an embodied and broadly described herein, the drying apparatus of this invention comprises a stationary housing, a horizontal shaft fixedly mounted within the housing and a rotatable double drum journaled on the shaft in which the clothes or other materials to be dried are held. The rotatable double drum assembly is comprised of two radially displaced perforated wall portions which define, with an end perforate wall portion, the compartment for holding clothes, and a third outermost imperforate wall portion which defines in conjunction with one of the perforated wall portions an annular compartment within the double drum. The third outermost imperforate wall is attached to an end imperforate wall portion which encloses but is spaced apart from the perforate wall portions. This invention further includes means for sealing the double drum. An exhaust pump mechanism mounted on the horizontal shaft having a rotor which rotates with the double drum assembly is in communication with the annular compartment of the double drum assembly to exhaust air and water vapor from the sealed interior of the double drum during operation. A radiant heat element can be mounted along the center axis of the double drum on the horizontal shaft and directed into the clothes compartment to further enhance and expedite removal of moisture from the clothes or other materials contained therein.

The invention consists in the novel elements, constructions, arrangements, combinations and improvements shown and described. The accompanying drawings, which are incorporated in and constitute a part of the specification, illustrate the preferred embodiment of the invention and, together with the description, serve to explain the principles of the invention.

DESCRIPTION OF THE PREFERRED EMBODIMENT

Reference will now be made in detail to the present preferred embodiment of the invention as shown and illustrated in the accompanying drawings.

Figure 1:
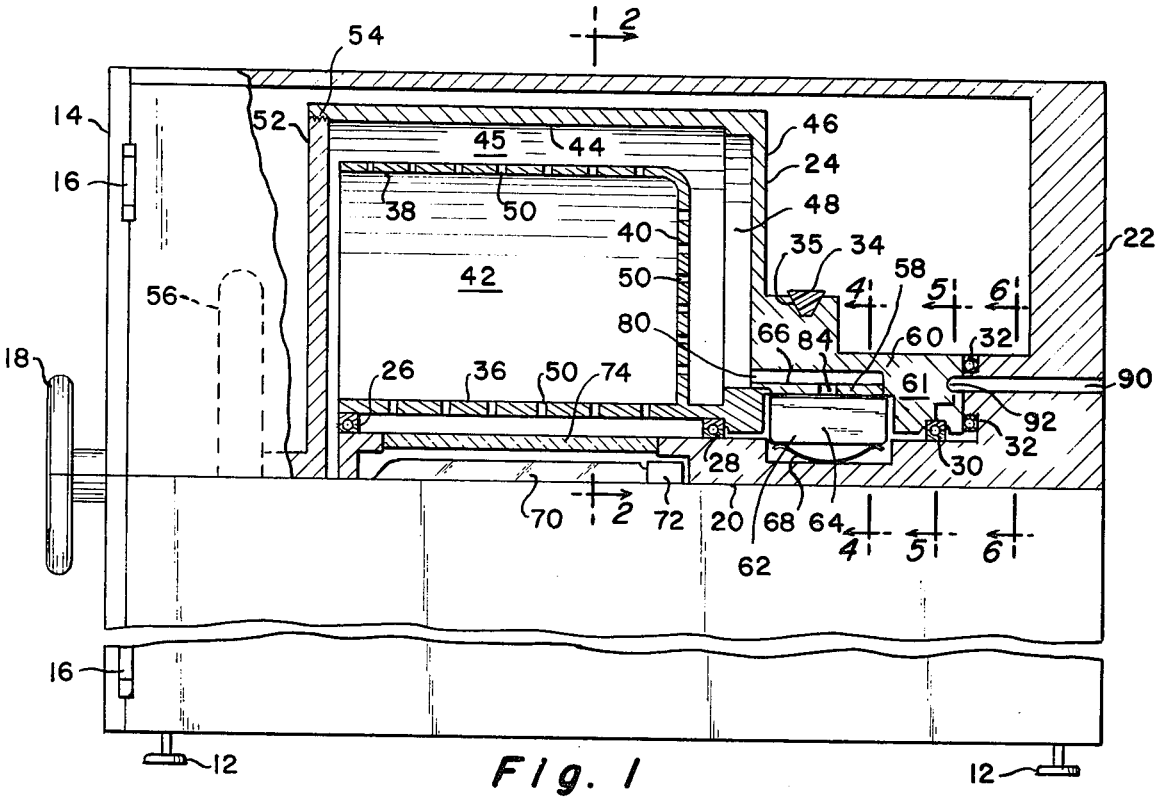
FIG. 1 is a partial section of the vacuum clothes dryer of this invention.
Figure 2:
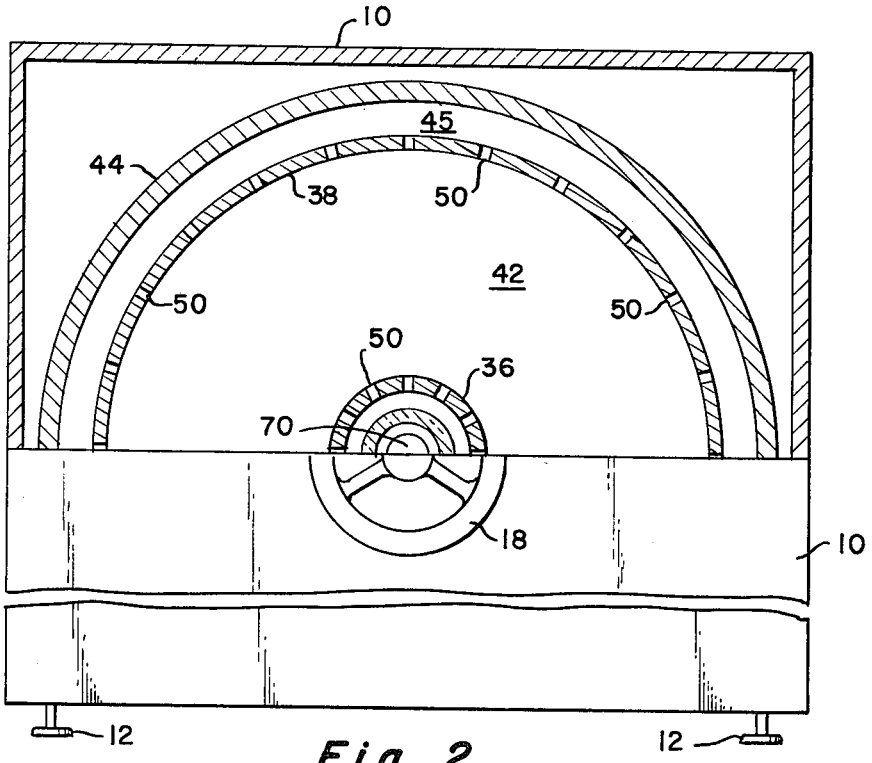
FIG. 2 is a partial cross sectional view of the clothes dryer of FIG. 1 taken at section line 2—2 of FIG. 1.

Referring to FIG. 1, a clothes dryer utilizing the concepts and principles of this invention is shown. In accordance with the invention, the clothes dryer includes a stationary housing which includes a cabinet 10, feet 12 and a door 14 which is attached to the cabinet 10 by hinges 16. A handle 18 is provided for latching the door 14 closed to the cabinet 10. Cabinet 10 encloses all the internal components of the dryer but is not itself airtight.

In accordance with the invention, a horizontal center shaft 20 is fixedly mounted within the cabinet 10. The shaft 20 extends horizontally from an end wall 22 of cabinet 10.

As further shown in FIG. 1 a rotatable double drum assembly 24 is journaled on the horizontal shaft 20 by roller or equivalent bearings 26, 28, and 30 and thrust bearing 32. The double drum 24 rotates on bearings 26, 28, 30, and 32 about the center shaft 20 impelled by pulley 34 which is fitted in groove 35 of the double drum assembly 24 and driven by a motor (not shown).

Preferably the double drum 24 includes two radially displaced perforate cylindrical wall portions 36 and 38 and a perforate end wall 40 joining the end wall portions 36 and 38. The wall portions 36, 38 and 40 define a compartment 42 for holding clothes or other materials for drying. It will be appreciated that wall portion 38 could be eliminated and wall 40 extended to join exterior wall 44. This latter configuration would be less efficient for removing water vapor from the double drum assembly but would be functional.

Preferably the double drum 24 further includes an outermost radially displaced imperforate wall portion 44 which in conjunction with perforate wall portion 38 defines an annular space 45 within the double drum assembly 24. End wall portion 46 of double drum assembly 24 is laterally displaced from perforate end wall portion 40 providing a space 48 which is in communication with annular space 45. The double drum assembly 24 thus resembles a perforate cup within, but spaced apart from, an imperforate cup both aligned on and concentric with the same horizontal axis.

Preferably the perforate wall portions 36, 38 and 40 are provided with small openings 50 which permit the free passage of moisture and vapor. As the double drum assembly 24 rotates, the moisture and air are drawn into spaces 45 and 48 through the openings 50 in a manner to be described in more detail below.

The double drum assembly 24 can be sealed in an air tight manner by means herein embodied as lid 52 provided with a threaded periphery which mates with a threaded portion 54 of the wall protion 44. The lid 52 is tightened by means of rotary handle 56.

In accordance with the invention, means are mounted on the horizontal shaft 20 in communicating relationship with annular space 45 and end space 48 for exhausting air and water vapor from the double drum assembly 24 thereby reducing the pressure within the double drum 24 to enhance and expedite the drying process. Preferably the exhausting means comprises a rotary sliding vane pump 58 having a rotor 60, shown here as an integral part of the double drum assembly 24, (see FIG. 3) which rotates with the double drum assembly 24, and a stator 62 (see FIG. 4) which is stationary and affixed to center shaft 20. As depicted in FIG. 1 sliding vanes 64 are urged against the interior elliptical rotor walls 78 by spring action of a buggy or equivalent type spring 68. The elements and operation of the exhaust pump 58 are discussed in greater detail below with reference to FIGS. 3–6.

In accordance with this invention, a radiant heating element 70 is mounted on the horizontal shaft 20 in electrical connection 72. Element 70, which for instance can be an infrared energy source, is aligned with the central horizontal axis of double drum assembly 24 is directed into the compartment 42 for vaporizing moisture therein. A transparent material 74 seals the radiant heating element 70 from moisture leakage while permitting the radiation of heat there through. Further the openings 50 in perforated wall portion 36 allow the radiated heat into the interior of compartment 42.

Figure 3:
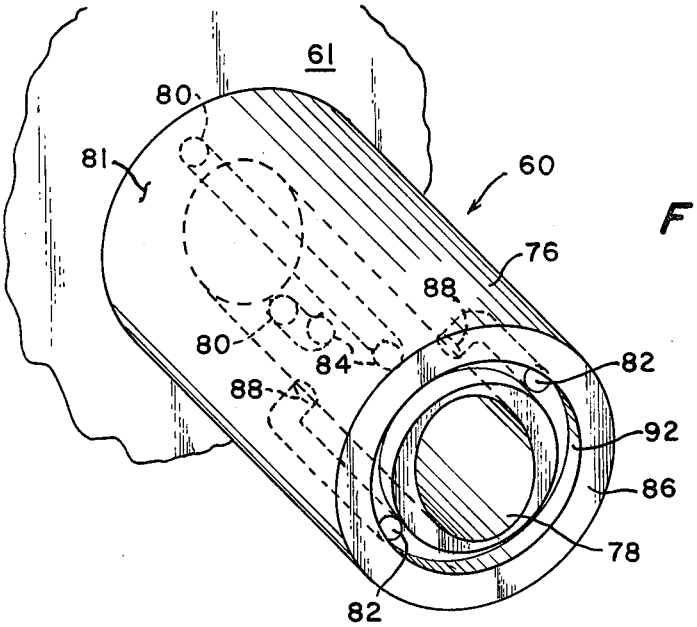
FIG. 3 is an isometric view of the elliptical rotor portion of the exhaust pump used in the embodiment of FIG. 1.

Referring now to FIG. 3, there is shown a typical rotor assembly 60 for use with the exhaust pump 58. The rotor 60 is shown cut away from neck portion 61 of the double drum assembly 24, and although shown in FIG. 1 as an integral part of the neck portion, it can be separately mounted within the neck portion 61 of drum assembly 24. The rotor 60 has an external cylindrical surface 76, the cross section of which is circular, and an interior surface 78, the cross section of which is elliptical. Although not shown in FIG. 3 the shaft 20 and stator 62 project through the center elliptical portion of the rotor 60.

Preferably inlet ducts 80 which communicate with end space 48 of the double drum 24 in FIG. 1, project through end wall 81. Ducts 80 communicate to the interior of rotor 60 at inlet openings 84. Preferably outlet ducts 82 are located in the end wall 86 of rotor 60 on a center line perpendicular to the axis through inlet ducts 80. The outlet ducts 82 communicate to the interior of rotor 60 at openings 88. The openings 88 are on a center line which is perpendicular to the axis through openings 84.

Preferably groove 92 is cut in the end wall 86 of rotor 60. The exhaust ducts 82 communicate, regardless of rotational orientation of the rotor, with the exit duct 90 through cabinet end wall 22, as shown by FIG. 1, by means of groove 92 in end wall 86 of rotor 60.

In operation the rotor 60 rotates about the stator 62 and shaft 20 causing an exhaust pump action drawing air and water vapor from annular space 45 and end space 48 of the double drum assembly 24 through inlet ducts 80 into the stator compartments. The air and water vapor is exhausted from stator compartments, after 90° rotation of the rotor 60, through outlet ducts 82 to groove 92.

Figure 4:
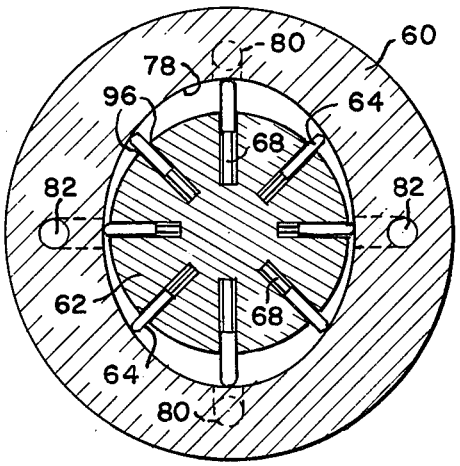
FIG. 4 is a cross sectional view taken at section line 4—4 of FIG. 1.
Figure 5:
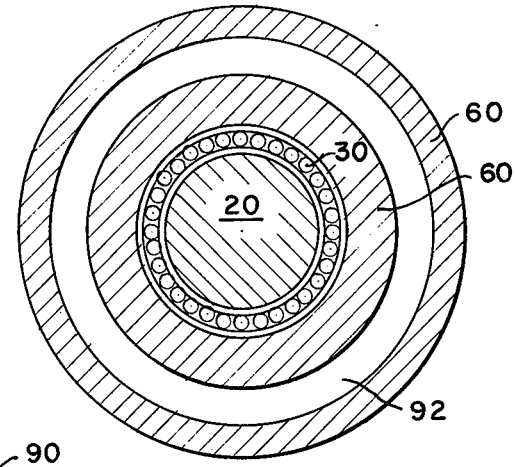
FIG. 5 is a cross sectional view taken at section line 5—4 of FIG. 1.
Figure 6:
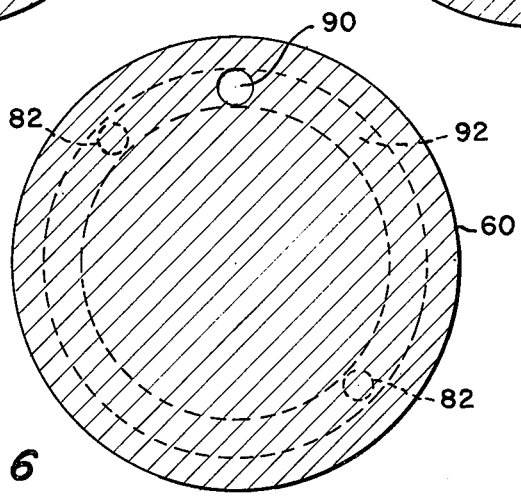
FIG. 6 is a cross sectional view taken at section line 6—6 of FIG. 1.

FIGS. 4, 5 and 6 represent cross sections taken through the exhaust pump 58 and associated duct work in shaft 20. By means of FIG. 4 the operation of the exhaust pump can be more particularly described. Rotor 60 has a stationary cylindrical stator 62 projecting through its center portion. Stator 62, affixed to or integral with stationary shaft 20, is provided with a plurality of longitudinal slots 96 in which vanes 64 slide. At the bottoms of slots 96 are located springs 68 which urge vanes 64 against the interior wall 78 of rotor 60. As rotor 60 rotates air and water vapor are drawn through inlet ducts 80 into the variable volume stator compartments defined by the sliding vanes 64. As the rotor 60 rotates the space into which the vapor and air is received is reduced in volume until it exits under increased pressure through an outlet duct 82. Upon another 90° rotation of the rotor 60, the volume of the stator compartment increases creating a partial vacuum to exhaust the interior of double drum 24 through inlet duct 80. The cycle then repeats. It is to be understood that this is but one type of exhaust pump which can be incorporated with the clothes dryer of this invention. For instance interior configurations other than elliptical (e.g., semi elliptical) can be used to effectively exhaust the interior of the double drum 24.

In FIG. 5, a sectional view taken along section line 505 of FIG. 1, there is shown the center shaft 20 having roller or equivalent bearings 32 mounted thereon for journaling the rotor assembly 60. A groove 92 of circular or square cross section preferably is cut in the end portion of rotor 60. Grove 92 may also be cut into end wall 22 oposite the end portion of rotor 60.

FIG. 6, a sectional view taken along section line 6—6, shows the relationship between the stationary exit duct 90 which passes through end wall 22 and the outlet ducts 82 incorporated in the rotatable rotor 60. The two ducts 82 and the exit duct 90 of which there can be any number are oriented at a radial distance corresponding to the radius of groove 92 so that water vapor and air exhausted through outlet ducts 82 can be exited through groove 92 to exit duct 90.

The clothes dryer described above operates as follows: The compartment door 14 is opened and the enclosure lid 52 is unscrewed by use of rotary handle 56. The wet clothes or other wet material are placed in compartment 42 of the double drum 24. The lid 52 is screwed into place to form an airtight seal for the double drum assembly 24. A motive force is applied through pulley belt 34 to the double drum assembly 24 such as by action of an electric motor (not shown). The double drum assembly 24 rotates about the center axis of shaft 20. Simultaneously the radiant heat element 70 is activated and radiates, for instance infrared energy, into the compartment 42. As the double drum assembly 24 rotates the rotary sliding vane vacuum pump 58 is activated and brings about a condition of partial vacuum within compartment 42. The moisture in the clothes begin to evaporate rapidly even though the temperature can be comparatively low, e.g., 100°–125° Farenheit. The water vapor is drawn through annular space 45 and end space 48 to inlet duct 80 where it is received into the stator compartments defined by the vanes 64 and then pushed out through the exhaust ducts 82. The air and water vapor passes through exit duct 90 to the exterior of cabinet 10. After a short period of time all the moisture in the clothes will be evaporated and the dryer can be stopped.

After the drying process has stopped, the door 14 is opened, the lid 52 is opened by turning handle 56 and the dry clothes are removed. Although not shown here, a bleed valve can be mounted in the wall of the double drum assembly 24 which can be opened after the clothes have been dried but prior to removal of the clothes. Fresh air then is circulated within the drum 24 while still rotating to fluff the clothes therein. The fresh air will be pumped through the interior space of double drum 24 including areas 42, 45 and 48 by the action of the rotary vane vacuum pump and then exhausted out the exit port 90.

The present invention, because of better efficiency of operation, will normally consume less energy than most conventional clothes dryers. Power is consumed only by the electric motor to drive the double drum 24 and by the radiant heating element 70. Rotation of the double drum 24 tumbles the clothes (normal to most conventional dryers) while operating the exhaust pump 58 to reduce the interior pressure. Reduced pressure within compartment 42 means less heat will be required to dry the clothes.

It would be apparent to those skilled in the art, that various modifications and variations could be made in the clothes dryer of this invention without departing from the scope or spirit of the invention.

What is claimed is:

1. A clothes dryer comprising;

a stationary housing;

a horizontal shaft fixedly mounted within said housing;

a rotatable double drum journaled on said shaft;

said double drum having two perforate cylindrical wall portions radially spaced from said shaft and attached to an end perforate wall portion to define a compartment for holding clothes and a third outermost imperforate cylindrical wall portion radially spaced from said shaft and joined to an end imperforate wall portion defining in conjunction with the outermost of said perforate wall portion and said end perforate wall portion an annular space and an end space respectively;

means for sealably closing said double drum; and pump means mounted on said horizontal shaft having a rotor portion rotatable with said double drum and in communicating relation to said annular space and said end space for exhausting air and water vapor from said double drum thereby reducing the pressure within said double drum.

2. The clothes dryer of claim 1 further including a radiant heating element mounted on said horizontal shaft directed into said compartment for holding clothes for vaporizing moisture therein.

3. The clothes dryer of claim 2 wherein said radiant heating element is an infrared heat energy source.

4. The clothes dryer of claim 1 wherein said pump means is a rotary sliding vane pump.

5. A clothes dryer comprising:

a stationary housing;

a horizontal shaft fixedly mounted within said housing;

a rotatable double drum with imperforate exterior wall portions journaled on said shaft;

said double drum having an interior compartment with perforate wall portions for holding clothes and a peripheral space about said interior compartment defined by said perforate wall portions and said exterior imperforate wall portions;

means for sealably closing said double drum; and pump means mounted on said horizontal shaft having a rotor rotatable with said double drum and in communicating relation to the interior of said double drum for exhausting air and water vapor from said double drum.

* * * * *

UNITED STATES PATENT AND TRADEMARK OFFICE

CERTIFICATE OF CORRECTION

PATENT NO. : 4,041,614

DATED : August 16, 1977

INVENTOR(S) : Norman A. Robinet

It is certified that error appears in the above-identified patent and that said Letters Patent are hereby corrected as shown below:

Column 1, line 34, delete "an" and insert therefor --as--.

Column 2, line 42, after "pulley" insert --belt--.

Column 2, line 14, delete "5-4" and insert therefor --5-5--.

Column 4, line 29, delete "505" and insert therefor --5-5--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*